United States Patent [19]

Iwamuro et al.

[11] 4,252,893

[45] Feb. 24, 1981

[54] LIGHT-SENSITIVE SILVER HALIDE PHOTOGRAPHIC MATERIAL

[75] Inventors: Masao Iwamuro, Ohme; Kenichiro Okaniwa; Takashi Sasaki, both of Hino; Shizuo Saito, Hachioji; Eiichi Sakamoto, Hanno, all of Japan

[73] Assignee: Konishiroku Photo Industry Co., Ltd., Tokyo, Japan

[21] Appl. No.: 29,028

[22] Filed: Apr. 11, 1979

[30] Foreign Application Priority Data

Apr. 11, 1979 [JP] Japan ..... 54-42380

[51] Int. Cl.[3] ..... G03C 1/40

[52] U.S. Cl. ..... 430/504; 430/607; 430/551

[58] Field of Search ..... 430/551, 607, 375, 376, 430/504

[56] References Cited

U.S. PATENT DOCUMENTS

| | | | |
|---|---|---|---|
| 3,582,333 | 6/1971 | yost et al. | 430/551 |
| 3,698,909 | 10/1972 | Lestina et al. | 430/551 |
| 3,764,337 | 10/1973 | Arai et al. | 430/551 |
| 3,929,486 | 12/1975 | Habu et al. | 430/607 |

*Primary Examiner*—J. Travis Brown

[57] ABSTRACT

A photographic material having a light-sensitive silver halide emulsion layer coated on a support. The material contains a compound represented by the following general formula [Ia] or [Ib]

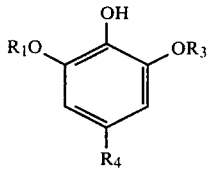

[Ia],

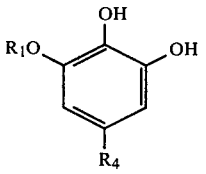

[Ib]

wherein $R_1$ and $R_3$ individually represent an alkyl, alkenyl or acyl group; $R_4$ represents a halogen atom, an alkyl, alkenyl, cycloalkyl or cyano group, or $—SO_2R_5$ or $—COR_5$ group; and $R_5$ represents a hydrogen atom, a hydroxy, alkyl, alkoxy, cycloalkoxy, aryloxy or amino group.

8 Claims, No Drawings

LIGHT-SENSITIVE SILVER HALIDE PHOTOGRAPHIC MATERIAL

This invention relates to a light-sensitive silver halide photographic material and more particularly to a light-sensitive silver halide photographic material improved in stability of its photographic properties on storage with the lapse of time.

Generally, light-sensitive silver halide photographic materials on development, even without exposure prior to the development, tend to form the so-called chemical fog wherein black silver deposits. In the case of color photographic materials, on the one hand, a detectable amount of black silver formed in the areas where no exposure was given oxidizes a color developing agent present in a color developer and the oxidized color developing agent reacts with couplers to form color fog, which is also called chemical fog.

This chemical fog (hereinafter simply called "fog") markedly takes place on storage of light-sensitive silver halide photographic materials (hereinafter simply called "photographic materials") under severe conditions, particularly under the circumstances of high temperature or humidity or both. In the field of photographic materials, this occurence of fog is deemed to be a fatal defect since it markedly deteriorates the quality of images formed on the photographic materials so stored. Recently, moreover, it has become an important problem to inhibit occurrence of fog on photographic materials which are often highly sensitized or processed rapidly at high temperature, or the like.

It has heretofore been well known, as a measure to control such occurrence of fog, to those skilled in the art to incorporate into photographic materials such substances commonly known as "antiffogants", for example, tetrazaindene compounds, mercapto compounds, quaternary ammonium salts, polyhydroxybenzene compounds, thion compounds or inorganic salts. The conventional antifoggants referred to above, however, are not found yet to sufficiently control the fog that occurs on storage, especially storage under severe conditions, on up-to-date photographic materials having high sensitivity and adaptability to high-temperatured rapid processing. Furthermore, most of the antifoggants have such drawback that they markedly deteriorate photographic properties such as photographic sensitivity, etc. On that account, heretofore the use of the antifoggants has been kept within limits where no photographic properties are adversely affected, or the antifoggants have been used in order to sufficiently control occurrence of fog at the sacrifice of photographic properties, and thus are the existing circumstances.

Of the commonly known antifoggants, polyhydroxybenzene derivatives, particularly derivatives of gallic acid or derivatives of gallic acid alkylester as disclosed in Japanese Patent Publication No. 4133/1968, have been known to have a fog inhibition effect on photographic materials stored under severe circumstances of high temperature or humidity or both. These derivatives, however, have such drawback that when they are applied to color photographic materials, gallic acid or derivatives of gallic acid alkylester elutes from said photographic materials under photographic processing and accumulate particularly into a color developing bath, thereby bringing about a strong development-inhibiting action. When taking into account the up-to-date photographic process wherein the use of an automatic developing machine is predominant and most of the automatic developing machines used are controlled by the replenishment system adapted to the continuous processing of much film, it is understood that much amount of gallic acid or its alkylester becomes accumulated in a developing bath that the amount exerts markedly an adverse effect on processing performance.

In view of the actual state where high sensitization of up-to-date photographic materials or rapid and stable operation of photographic processing at elevated temperatures is keenly desired, new antifoggants has been desired to photographic circles, which antifoggants are capable of inhibiting spontaneous formation of fog during storage for long time without deteriorating photographic properties and, moreover, are free of property to inhibit development even when they elute into a developing bath and then accumulate therein.

After having been exposed, furthermore, generally the photographic materials are often left as they are for a long period of time before development thereof. Usually, latent images are formed on exposure and the formed latent images are then converted into dye images through silver images or couplers during the development. The formed latent images, per se, are generally labile to a considerable extent and when they are left for a long time during a period from the exposure up to the development, they tend to regress or progress. This phenomenon is well known to those skilled in the art and generally called "latent image fluctuation". When this latent image fluctuation occurs differently in each photosensitive photographic layer, particularly of integral multi-layered color photographic materials, a disturbance is caused in color balance among the photographic layers, with the result that a fatal influence is exerted on a performance of color reproduction. As a measure to inhibit the occurrence of this latent image fluctuation, there has been known a procedure involving incorporation into photographic materials of such materials, for example, as sulfur-containing amino acid type derivatives, nitrogen-containing heterocyclic compounds, mercapto type compounds, nitrilotriacetic acid guanazoles or the like. In the above-mentioned procedure, however, there is obtained by no means a satisfactory effect desired for accomplishing our object to provide photographic materials which are very small in range of latent image fluctuation, and the development of novel latent image stabilizers has been strongly demanded.

Accordingly, a primary object of the present invention is to provide photographic materials which have been prevented from formation of fog on storage for a long time.

A secondary object of the present invention is to provide photographic materials which are free from latent image fluctuation on storage for a long time.

A third object of the present invention is to provide photographic materials which are free of property of inhibiting processings, particularly development, in a continuous photographic process.

As the result of extensive studies, the present inventors have found that the objects of the present invention can be accomplished by incorporation into photographic materials of at least one of the compounds represented by the following general formula [I]. That is by the incorporation into photographic materials of the compounds represented by the following general formula [I] according to the present invention, formation of fog on prolonged storage can favorably be controlled without deteriorating sensitivity of the photographic materials and, moreover, even when the compounds elute to accumulate in a developing solution at the time of photographic process, no development inhibition is observed and no adverse effect on processing performance is seen.

General formula (I)

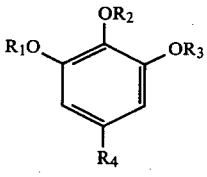

In the general formula [I], $R_1$, $R_2$ and $R_3$ individually represent a hydrogen atom, an alkyl, alkenyl or acyl group, and $R_4$ represents a halogen atom, an alkyl, alkenyl, cyano cycloalkyl, $—SO_2R_5$ or $—COR_5$ in which $R_5$ represents a hydrogen atom, an alkyl, hydroxy, alkoxy, cycloalkyloxy, aryloxy or amino group.

Provided that $R_1$, $R_2$ and $R_3$ are not simultaneously taken as hydrogen atoms.

In the general formula [I], the halogen atom may be, e.g. fluorine, chlorine, bromine or iodine; the alkyl group may be any of either straight-chain or branched alkyls, preferably those of 1 to 32 carbon atoms, e.g. methyl, ethyl, n-butyl, t-butyl, 2-ethyl-hexyl, 3,3,5-trimethyl-hexyl, 2,2-dimethylpentyl, n-octyl, t-octyl, n-dodecyl, n-octadecyl or eicosyl; the alkenyl group may be any of either straight-chain or branched alkenyls, preferably those of 2 to 32 carbon atoms, e.g. allyl, butenyl, octenyl or eleyl; the cycloalkyl group is preferably any of 5- to 7-membered cycloalkyls, e.g. cyclopentyl, cyclohexyl or cycloheptyl; the alkoxy group may be, e.g. methoxy, ethoxy, n-propoxy, t-butoxy, n-butoxy, n-hexoxy, n-dodeoxy, or n-octadeoxy; the cycloalkyloxy group may be cyclopentyloxy, cyclohexyloxy or cyclobutyloxy; the amino group may be, e.g. amino, methylamino, dimethylamino, n-propylamino, n-octadecylamino or n-docosylamino; the acyl group may be, e.g. acetyl, propionyl, butyryl, hexanoyl, stearoyl, benzoyl or naphthoyl; and the aryloxy group may be, e.g. phenoxy, 2,5-di-t-amylphenoxy or naphtoxy.

The alkyl, alkenyl, cycloalkyl, aryloxy or amino group in the above-mentioned groups may individually have a substituent, and typical of the substituent may be, for example, a halogen atom, a hydroxy, carboxyl, sulfo, cyano, alkyl, alkenyl, alkoxy, alkenyloxy, aryl, aryloxy, arylamino, alkylamino, alkenylamino, alkoxycarbonyl or aryloxycarbonyl.

Of the compounds represented by the general formula [I], preferable are those represented by the following general formula [I-a] or [I-b].

General formula (I-a)

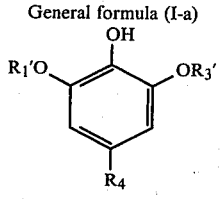

General formula (I-b)

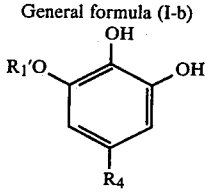

In the above formulas, $R'_1$ and $R'_3$ individually represent an alkyl, alkenyl or acyl group which may have substituents as mentioned above, and $R_4$ is the same as defined in the general formula [I]. Preferable examples of $R'_1$ and $R'_3$ are an alkyl group or acyl group individually, and $R_4$ is preferably a carboxy, alkoxycarbonyl, carboxyalkyl, alkoxycarboxyalkyl or alkylaminocarbonyl group, wherein the alkyl group is preferably one whose number of carbon atoms are 1 to 12, particularly 1 to 4.

Representative compounds of the present invention are exemplified below in Table 1. However, it should be construed that the compounds used in the present invention are not limited to those as exemplified.

TABLE 1

Exemplified compound

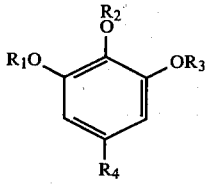

| No. | $R_1$ | $R_2$ | $R_3$ | $R_4$ |
|---|---|---|---|---|
| 1 | $—CH_3$ | $—CH_3$ | $—CH_3$ | $—CONHC_4H_9(n)$ |
| 2 | $—CH_3$ | $—H$ | $—CH_3$ | $—CO_2—C_6H_4—CH_3$ |
| 3 | $—CH_3$ | $—H$ | $—CH_3$ | $—CONHC_3H_7(n)$ |
| 4 | $—CH_3$ | $—H$ | $—CH_3$ | $—CONH_2$ |
| 5 | $—CO—C_6H_4—CH_3$ | $—CO—C_6H_4—CH_3$ | $—CO—C_6H_4—CH_3$ | $—CONHC_{14}H_{29}(n)$ |
| 6 | $—C_5H_{11}$-n | $—H$ | $—C_5H_{11}$-n | $—CONH—C_6H_5$ |
| 7 | $—CH_3$ | $—H$ | $—CH_3$ | $—CN$ |
| 8 | $—CH_3$ | $—H$ | $—CH_3$ | $—COC_5H_{11}(n)$ |
| 9 | $—CH_3$ | $—H$ | $—CH_3$ | $—CH_2CH=CH_2$ |
| 10 | $—COCH_3$ | $—H$ | $—COCH_3$ | $—COC_{12}H_{25}(n)$ |
| 11 | $—CH_3$ | $—H$ | $—CH_3$ | $—CH_3$ |
| 12 | $—CH_3$ | $—H$ | $—CH_3$ | $—Cl$ |
| 13 | $—CH_3$ | $—CH_3$ | $—CH_3$ | $—C_4H_{11}(t)$ |
| 14 | $—CO—C_6H_5$ | $—H$ | $—CO—C_6H_5$ | $—C_5H_{11}(n)$ |

TABLE 1-continued

Exemplified compound

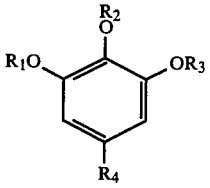

| No. | $R_1$ | $R_2$ | $R_3$ | $R_4$ |
|---|---|---|---|---|
| 15 | $-CH_3$ | $-H$ | $-CH_3$ | $-C_8H_{17}(n)$ |
| 16 | $-CH_3$ | $-H$ | $-CH_3$ | $-CH_2COOH$ |
| 17 | $-COCH_3$ | $-COCH_3$ | $-COCH_3$ | $-CH_2COOH$ |
| 18 | $-CH_3$ | $-COCH_3$ | $-COCH_3$ | $-CH_2COOH$ |
| 19 | $-CH_3$ | $-H$ | $-H$ | $-CH_2COOH$ |
| 20 | $-COC_3H_7(n)$ | $-COC_3H_7(n)$ | $-H$ | 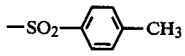 |
| 21 | $-CH_3$ | $-H$ | $-CH_3$ | $-CH_2COOC_{12}H_{25}(n)$ |
| 22 | $-CH_3$ | $-H$ | $-CH_3$ | $-CHO$ |
| 23 | $-CH_3$ | $-H$ | $-CH_3$ | $-CH_2OH$ |
| 24 | $-CH_3$ | $-H$ | $-H$ | $-CH_2OCOCH_3$ |
| 25 | $-CH_3$ | $-H$ | $-H$ | 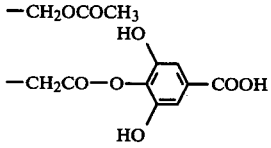 |
| 26 | $-CH_3$ | $-H$ | $-CH_3$ | 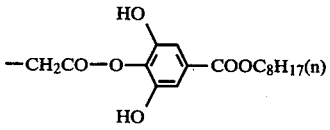 |
| 27 | $-CH_3$ | $-H$ | $-CH_3$ | $-CH_2CH_2COOH$ |
| 28 | $-CH_3$ | $-CH_3$ | $-CH_3$ | $-CH_2COOH$ |
| 29 | 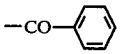 | $-H$ | $-H$ | $-CH_2COOH$ |
| 30 | $-CH_3$ | $-H$ | $-H$ | $-CH_2CH_2COOC_{12}H_{25}(n)$ |
| 31 | $-COCH_3$ | $-COCH_3$ | $-COCH_3$ | $-COOH$ |
| 32 | $-CH_3$ | $-CH_3$ | $-CH_3$ | 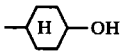 |
| 33 | $-CH_3$ | $-H$ | $-CH_3$ | $-SO_2CH_3$ |
| 34 | $-CH_3$ | $-H$ | $-CH_3$ | $-COOH$ |
| 35 | 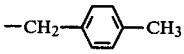 | $-H$ | 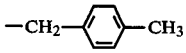 | $-COOH$ |
| 36 | $-C_2H_5$ | $-H$ | $-C_2H_5$ | $-COOH$ |
| 37 | $-COCH_3$ | $-H$ | $-COCH_3$ | $-COOH$ |
| 38 | $-COCH_3$ | $-COCH_3$ | $-COCH_3$ | $-COOC_3H_7(n)$ |
| 39 | 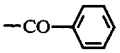 | 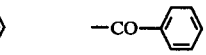 | $-CH_3$ | $-COOC_7H_{15}(n)$ |
| 40 | $-CH_3$ | $-H$ | $-CH_3$ | 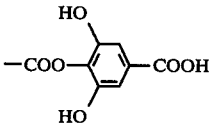 |
| 41 | $-COCH_3$ | $-COCH_3$ | $-COCH_3$ | 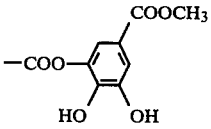 |
| 42 | $-CH_3$ | $-H$ | $-CH_3$ | $-COOC_3H_7(n)$ |
| 43 | $-CH_3$ | $-H$ | $-H$ | $-COOC_{12}H_{25}(n)$ |
| 44 | $-CH_3$ | $-H$ | $-CH_3$ | 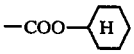 |
| 45 | $-CH_3$ | $-H$ | $-H$ | 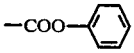 |
| 46 | $-CH_3$ | $-H$ | $-CH_3$ | 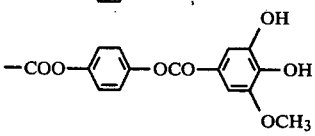 |

TABLE 1-continued

Exemplified compound

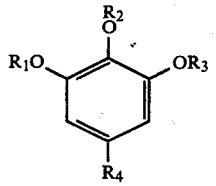

| No. | $R_1$ | $R_2$ | $R_3$ | $R_4$ |
|---|---|---|---|---|
| 47 | $-CH_3$ | $-H$ | $-CH_3$ | $-CH_2COOC_3H_7(n)$ |
| 48 | 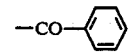 | 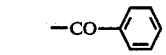 | 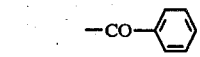 | $-CH_2COOC_8H_{17}(n)$ |
| 49 | $-CH_3$ | $-CH_3$ | $-CH_3$ | $-COOH$ |
| 50 | $-COCH_3$ | $-COCH_3$ | $-COCH_3$ | 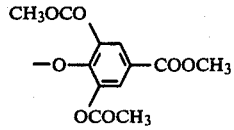 |
| 51 | $-CH_3$ | $-CH_3$ | $-CH_3$ | $-CH_2COOC_3H_7(n)$ |
| 52 | $-CH_3$ | $-H$ | $-H$ | $-Cl$ |
| 53 | $-COCH_3$ | $-COCH_3$ | $-COCH_3$ | 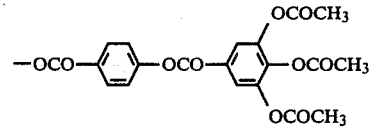 |
| 54 | $-CH_3$ | $-CH_3$ | $-CH_3$ | $-CO_2C_3H_7(n)$ |

The above-exemplified compounds may be prepared according to procedures as described in Journal of the American Chemical Society, Vol. 51, 571 (1929) and Vol. 68, 500 (1946), and Organic Synthesis, Coll. Vol. 1, 537. That is, the compounds can readily be prepared by reacting a 1,2,3-trihydroxybenzene compound in the presence of alkali with an alkylating agent such as alkylhalide or alkylsulfuric acid or with an acylating agent such as acid chloride, or alternatively these compounds are also commercially available.

Furthermore, the present inventors have found that photographic materials quite excellent in latent image stability on prolonged storage, which are directed to the secondary object of the present invention, are also obtained by incorporation into the photographic materials of at least one of the compounds represented by the aforesaid general formula [I] together with at least one of the compounds represented by the following general formula [II] or [III]. By the incorporation into photographic materials of at least one of the compounds of the aforesaid general formula [I], the effect of stabilizing latent images formed on exposure may certainly be observed. In addition thereto, however, the present inventors have found that the latent image stabilizing effect of the compounds of the aforesaid general formula [I] is markedly increased by the use of the compounds of the aforesaid general formula [I] together with the compounds of the following general formula [II] or [III].

This synergistic effect can be said to be really surprising in the light of the fact that practically no effect of stabilizing latent images is observed even when the compounds of the following general formula [II] or [III] are used singly or in combination with any compounds not falling within the general formula [I]. By application of the present invention, there can be obtained stable and excellent photographic materials less in fog or latent image fluctuation even when highly sensitized, which photographic materials are able to withstand prolong storage under high temperature and humidity circumstances or severe conditions such as rapid processing at elevated temperature.

General formula (II)

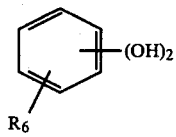

General formula (III)

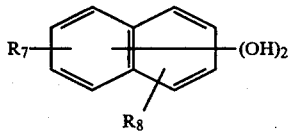

In the above formulas, $R_6$ represents an alkyl group, and $R_7$ and $R_8$ individually represent a hydrogen atom or an alkyl group. Provided that $R_7$ and $R_8$ are not simultaneously hydrogen atoms, and that in the general formula [II], two hydroxy groups are in the ortho- or meta-position. In the general formula [III], two hydroxy groups are preferably in the ortho- or meta-position.

In the general formulas [II] and [III], the alkyl group may be any of either straight-chain or branched alkyls, preferably those of 1 to 32 carbon atoms, for example, methyl, ethyl, n-butyl, t-butyl, 2,2-dimethylpentyl, n-octyl, t-octyl, n-dodecyl, n-octadecyl or eicosyl. Of the compounds represented by the general formulas [II] or [III], preferable are those of the general formula [II], and those of the general formula [II] in which $R_6$ represents an alkyl group of 1 to 6 carbon atoms are more preferable, further, the two hydroxy groups are preferably in the ortho-position.

Typical compounds of the general formulas [II] and [III] according to the present invention are exemplified below, but it should be construed that the compounds used in the present invention are not limited to those as exemplified.

Exemplified compound

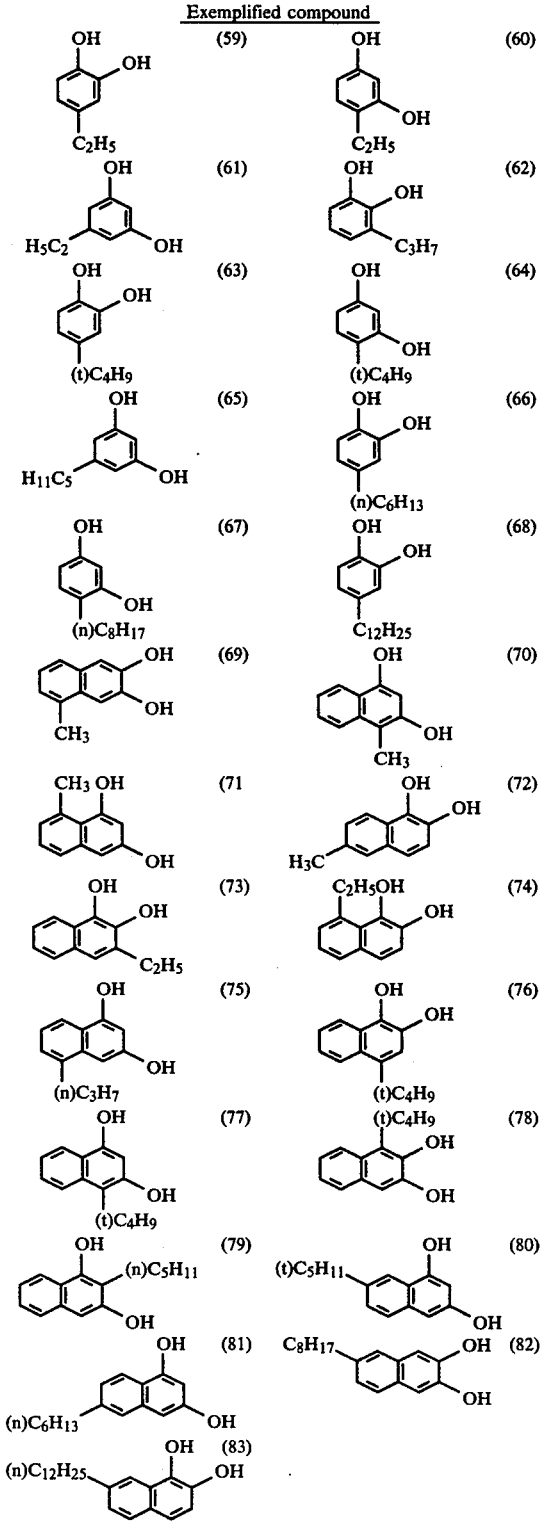

The compounds represented by the general formulas [II] and [III] may readily be prepared according to such procedures, for example, as disclosed in Journal of the American Chemical Society, Vol. 60, 7 (1938) and Collection of Czechoslovak Chemical Communication, Vol. 25, 766 (1960), and these compounds are also commercially available.

Although most preferably the compounds represented by the aforesaid general formulas [I], [II] and [III] according to the present invention are incorporated directly into silver halide emulsion layers, these compounds may be incorporated into non-photosensitive layers such as intermediate layer, protective layer, yellow filter layer, antihalation layer, etc. Furthermore, incorporation into both the silver halide emulsion layers and non-photosensitive layers of these compounds is also effective. In case of incorporation into silver halide emulsion layers of the compounds according to the present invention, the incorporation into silver halide emulsions of the present compounds may be carried out at any stage during a period before coating process, preferably during the period from chemical ripening up to the coating process, and more preferably after completion of the chemical ripening. Furthermore, in case of the incorporation into non-photosensitive layers of the present compounds, the addition to respective coating solutions for the non-photosensitive layers may be effected at any stage before the coating. The present compounds, when used, may be dissolved first in water, or in lower alcohols, esters or ketones or mixtures thereof which are compatible with water. Furthermore, the present compounds may be used after dissolving then in high boiling solvents or the like, followed by dispersions to prepare their respective dispersions. The amount of the present compound used is preferably in the range from 0.01 to 100 g, particularly preferably in the range from 0.05 to 50 g per mole of silver halide, but such amount may suitably be selected according to the kind of silver halide and of the present compound used. When the present compound is applied to layers containing no silver halide, such as an intermediate layer, protective layer, yellow filter layer, antihalation layer, etc., good results can be obtained by coating an aqueous gelatin solution containing the present compound in an amount ranging from 0.01 to 50 g, more preferably from 0.05 to 10 g per gram of gelatin, to form their respective non-silver halide layers.

The photographic materials according to the present invention encompass monochromatic photographic materials of every kind such as black-and-white panchromatic films, panlith and ortholith type films, microfilms, facsimile films, gravure films, panmasking films, indirect X-ray photographing films, direct X-ray high sensitive orthofilms, direct X-ray photographing films, high resoving dryplates, multi-gradation printing papers or black-and-white materials for the diffusion transfer process and color photographic materials of every kind such as color negative films, color positive films, inner or outer type color reversal films, aerial color photographic films, color X-ray films, color printing paper, photosensitive materials for the color diffusion transfer process or photosensitive materials for the silver dye bleach process.

The photographic materials according to the present invention are explained hereinafter.

The photographic materials according to the present invention comprise a support and thereon at least one silver halide emulsion layer.

Silver halide used in silver halide emulsion layers of the photographic materials of the present invention encompasses any silver halides commonly used in ordinary silver halide emulsions such as silver chloride, silver bromide, silver iodide, silver chlorobromide, silver iodobromide, silver chloroidobromide, etc.

These silver halide particles may be prepared according to the known procedures commonly adopted in the industry concerned. The silver halide is generally dispersed in gelatin. Besides the gelatin, however, there may also be used, for example, polymers such as polyvinyl alcohol, etc. in place of or in admixture with the gelatin. Silver halide emulsions having dispersed the silver halide in a suitable binder can chemically be sensitized according to any of procedures commonly adopted hitherto. That is, the emulsions may chemically sensitized with activated gelatin, noble metal sensitizers; sulfur sensitizers; selenium sensitizers; and chemical sensitizers, e.g. reduction sensitizers such as polyamines, stannous chloride, etc., and these sensitizers may be used either singly or in combination. The silver halide can be optically sensitized at a desired wavelength region, for example, the optical sensitization (e.g. super color sensitization) can be accomplished by the use, either singly or in combination, of optical sensitizers, for example, cyanine dyes such as zeromethine dye, monomethine dye, dimethine dye, trimethine dye, etc. or merocyanine dyes. Furthermore, the photographic materials according to the present invention may contain, according to the object for which they are used, various photographic additives in photosensitive layers and/or other constitutive layers (e.g. intermediate layer, sub layer, filter layer, protective layer, image receiving layer, etc.).

Usable photographic additives include, for example, stabilizers or antifoggants such as azaindenes, triazoles, tetrazoles, imidazolium salts, tetrazolium salts, polyhydroxy-compounds, etc.; hardeners of aldehyde type, aziridine type, inoxazole type, vinyl sulfone type, acrylolyl type, albodiimide type, maleimide type, methansulfonic acid ester type, riazine type, etc.; gradation regulators such as metals (e.g. rhodium, and ruthenium) or Group VIII in the periodic table or cadmium, thallium, etc.; development accelerators such as benzyl alcohol, polyoxyethylene compounds, etc.; image stabilizers of chroman type, coumaran type, bisphenol type or phosphorous acid ester type; and lubricants such as waxes, glycerides of higher fatty acids, higher alcohol esters of higher fatty acids, etc. Surface active agents of anion type, cation type, nonion type or of every kind such as amphoteric surfactants are usable as coating aids, emulsifiers, agents for improving permeability to processing solutions, deforming agents or materials for controlling various physical properties of photosensitive materials. As mordants, effectively usable are N-guanylhydrazone type compounds, quaternary ammonium salt compounds, etc. Effectively usable as antistatic agents are diacetylcellulose, styrene perfluoroalkyl lithium maleate copolymers, alkali salts of reaction products of styrene-maleic anhydride copolymer with p-aminobenzenesulfonic acid, etc. As color turbidity inhibitors, there may be mentioned polymers containing vinylpyrrolidone monomer, polymers containing vinyl imidazole monomer, etc. Usable matting agents include methyl polymethacrylate, polystyrene and alkali-soluble polymers. Furthermore, colloidal silicon oxide is also usable. As latexes for improving physical properties of coatings, there may be mentioned copolymers of acrylic ester or vinyl ester with other monomers having ethylene groups. As plasticizers for gelatin, there may be mentioned glycerine, glycol type compounds, etc., and styrene-sodium maleate copolymers, alkylvinyl ether-maleic acid copolymers and the like may be used as thickeners.

Further, silver halide emulsions for color photography are incorporated with couplers for forming color images. Useful couplers include open chain methylene type yellow couplers, pyrazolone type magenta couplers and phenol or naphthol type cyan couplers. In combination with these couplers, there may also be used color couplers (e.g. couplers having at the active point of coupler a split-off group having an azo group as a linking group) for masking purposes, osazone type compounds, couplers of the type releasing diffusible dyes on development, and development inhibitor releasing type compounds (these compounds release development inhibiting type on reaction with an oxidation product of an aromatic primary amine type developing agent and include both the so-called DIR couplers forming color dyes on reaction with an oxidized aromatic primary amine type developer and DIR substances forming colorless compounds). Various known techniques commonly used heretofore in connection with the use of couplers are applicable to incorporation into color photographic materials of the above-mentioned couplers.

The photographic materials according to the present invention are prepared by forming on a support silver halide emulsion layers having incorporated therein, if necessary, various photographic additives as aforesaid and other constitutive layers. Advantageously usable supports are such materials, for example, as baryta paper, polyethylene-coated paper, polypropylene synthetic paper, glass, films of cellulose acetate, cellulose nitrate, polyvinylacetal or polypropylene, polyester films, e.g. polyethylene terephthalate films or polystyrene films. These support materials are suitably selected according to the object for which the photographic material is used. If necessary, these supports are subjected to subbing treatment.

The photographic materials of the present invention can be developed after exposure to obtain images according to commonly used procedures, per se, known.

Black-and-white developers are alkali solutions containing a developing agent selected from hydroxybenzene, aminophenols, aminobenzenes, etc., and in addition thereto may contain alkali metal salts such as sulfites, carbonates, bisulfites, bromides, and iodides. The exposed color photographic materials of the present invention may be color developed according to commonly used color development techniques. There is no particular limit to the processing technique and any of known techniques is applicable.

Color developing agents particularly useful for the color development of the color photographic materials according to the present invention are primary phenylenediamines and their derivatives, typical of which are as illustrated below.

4-Amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(methoxyethoxy)ethoxy]ethyl-3-methyl-4-aminoaniline, N-ethyl-N-β-(β-methoxyethoxy)ethyl-3-methyl-4-aminoaniline or salts thereof, for example, sulfates, hydrochlorides, sulfites or p-toluenesulfonates.

The present invention is illustrated below with reference to examples. It should be construed however that the present invention is not limited to these examples.

EXAMPLE 1

After having been chemically sensitized according to gold and sulfur sensitizing techniques up to a fair sensitivity, a high speed silver iodobromide emulsion containing 1.5 mol% of silver iodide was incorporated with 4.0 g per mole of silver halide of 4-hydroxy-6-methyl-1,3,3a-7-tetrazaindene as a stabilizer. The thus obtained silver halide emulsion was divided into 19 portions. To a portion of the emulsion were added a coating aid and a hardener in their respective given amounts, and the resulting emulsion was coated on a polyethylene terephthalate film support to prepare a comparative sample (sample No. 1).

Separately, the remaining 18 portions of the emulsion were individually incorporated with each of the present exemplified compounds in the manner as indicated in Table-2 and then treated in the same manner as in the case of the comparative sample to prepare samples Nos. 2–19. The thus obtained samples and comparative sample were individually divided into two portions, one of which was stored for 3 days at 20° C. and 60% RH, and the other of which was stored for 3 days at 50° C. and 80% RH. Thereafter, these samples obtained were subjected to white light exposure according to the procedure as specified in JIS by the use of KS-1 Type sensitometer (manufactured by Konishiroku Photo Industry Co., Ltd.) and then subjected to high temperature rapid development at 40° C. for 30 seconds with a developer of the following composition by means of a continuous roller conveyor type automatic developing machine capable of carrying out a continuous operation of development, fixing water-washing and drying.

| (Composition of developer) | |
|---|---|
| Anhydrous sodium sulfite | 70 g |
| Hydroquinone | 10 g |
| Anhydrous boric acid | 1 g |

-continued

| (Composition of developer) | |
|---|---|
| Sodium carbonate monohydrate | 20 g |
| 1-Phenyl-1,3-pyrazolidone | 0.35 g |
| Sodium hydroxide | 5 g |
| 5-Methylbenzotriazole | 0.05 g |
| Potassium bromide | 5 g |
| Glutaraldehyde bisulfite | 15 g |
| Glacial acetic acid | 8 g |
| Water to 1 liter. | |

The fixing solution used was such as commonly known.

The thus processed samples and comparative sample were subjected to sensitometry to obtain the results as shown in Table-2.

In the table, the speed was represented by a relative value as measured by assuming as 100 the speed at 20° C. and 60% RH of the comparative sample (sample No. 1) containing no compound according to the present invention.

TABLE 2

| Sample No. | | Amount of compound added g/Ag mol | Stored for 3 days at 20° C. and 60% RH Speed | Fog | Stored for 3 days at 50° C. and 80% RH Speed | Fog |
|---|---|---|---|---|---|---|
| Comparative sample | 1 | Not added (Comparative) | 100 | 0.33 | 70 | 0.49 |
| Sample | 2 | Exemplified compound (1) 3.0 | 100 | 0.22 | 90 | 0.29 |
| | 3 | Exemplified compound (7) 3.0 | 105 | 0.15 | 105 | 0.15 |
| | 4 | Exemplified compound (13) 3.0 | 105 | 0.20 | 95 | 0.26 |
| | 5 | Exemplified compound (16) 3.0 | 100 | 0.13 | 105 | 0.15 |
| | 6 | Exemplified compound (19) 3.0 | 110 | 0.18 | 100 | 0.22 |
| | 7 | Exemplified compound (28) 3.0 | 100 | 0.23 | 95 | 0.30 |
| | 8 | Exemplified compound (29) 3.0 | 100 | 0.20 | 105 | 0.19 |
| | 9 | Exemplified compound (31) 3.0 | 100 | 0.22 | 100 | 0.28 |
| | 10 | Exemplified compound (33) 3.0 | 105 | 0.15 | 100 | 0.16 |
| | 11 | Exemplified compound (34) 3.0 | 100 | 0.11 | 105 | 0.11 |
| | 12 | Exemplified compound (38) 3.0 | 100 | 0.21 | 100 | 0.26 |
| | 13 | Exemplified compound (42) 3.0 | 100 | 0.14 | 100 | 0.15 |
| | 14 | Exemplified compound (43) 3.0 | 100 | 0.21 | 95 | 0.22 |
| | 15 | Exemplified compound (49) 3.0 | 100 | 0.26 | 95 | 0.31 |
| | 16 | Exemplified compound (50) 3.0 | 100 | 0.22 | 95 | 0.29 |
| | 17 | Exemplified compound (52) 3.0 | 100 | 0.20 | 100 | 0.24 |
| | 18 | Exemplified compound (53) 3.0 | 100 | 0.24 | 95 | 0.29 |
| | 19 | Exemplified compound (54) 3.0 | 100 | 0.25 | 100 | 0.27 |

As is clear from Table-2, it is understood that as compared with the comparative sample (1), the samples of high speed photographic materials to be subjected to high temperature rapid treatment demonstrated their effect on inhibition of fog formation and particularly excellent photographic performance less in fall of sensitivity as well as in fog formation by the use of the compounds according to the present invention.

It is also understood that among the compounds of the present invention used in this example, particularly exemplified compounds (7), (16), (19), (29), (33), (34), (42), (43) and (52) of the general formulas [I-a] and [I-b] respectively demonstrated favorable characteristics, and among these compounds, particularly exemplified compounds (7), (16), (33), (34) and (42) had most excellent stabilization effects on prolonged storage.

EXAMPLE 2

A silver iodobromide emulsion containing 7 mol% of silver iodide was prepared according to the usual procedure. This emulsion in an amount equivalent to one mole was sensitized chemically with gold and sulfur sensitizers, followed by incorporation with anhydro- 5,5'-dichloro-9-ethyl-3,3'-di-(3-sulfopropyl)oxacarbocyanine hydroxide, anhydro-5,5'-diphenyl-9-ethyl-3,3'-di-(3-sulfopropyl)oxacarbocyanone and anhydro-9-ethyl-3,3'-di-(3-sulfopropyl)-5,6,5',6'-dibenzooxacarbocyanine hydroxide. Subsequently, the emulsion was incorporated with 1200 ml of dispersion (M-1), saponin and 1,2-bisvinylsulfonylethane, coated on a cellulose triacetate base support and then dried to obtain a sample having formed thereon a stable coating, which was taken as a comparative sample (sample No. 1).

Dispersion (M-1)

$8\times10^{-2}$ Mole, per mole of silver halide, of 1-(2,4,6-trichlorophenyl)-3-[3-(2,4-di-tert-amylphenoxyacetamido)benzamido]-5-pyrazolone as a magenta coupler was mixed with tricresyl phosphate as a high boiling organic solvent in an equal amount of the coupler, and the mixture was completely dissolved in ethyl acetate by heating at 60° C. The solution was mixed with 50 ml of a 10% aqueous solution of Alkanol B (a registered trade name of alkylnaphthalene sulfonate produced by Du Pont Co.) and 700 ml of a 10% aqueous gelatin solution and dispersed by means of a colloid mill to obtain the title dispersion.

Subsequently, samples were prepared in the same manner as in the case of the comparative sample, except that after completion of the second ripening, the silver iodobromide emulsions were individually incorporated with gallic acid isoamylester as a comparative compound and the compounds of the present invention in the manner as indicated in Table-3.

The thus obtained samples and comparative sample were individually divided into three portions, one of which was stored under circumstances of 20° C. and 60% RH for 3 days, and a second one of which was stored under circumstances of 50° C. and 80% RH for 3 days. Thereafter, the samples and comparative samples thus treated were subjected to exposure by the procedure according to Example 1 and then processed according to the following photographic processing step.

Furthermore, a third one of the portions of each sample above was subjected to exposure according to the same procedure as above, and then stored under circumstances of 50° C. and 10% RH for 3 days, followed the similar treatment.

| (Processing step) (37.8° C.) | Processing time |
|---|---|
| 1. Color development | 3' 15" |
| 2. Bleaching | 6' 30" |
| 3. Water-washing | 3' 15" |
| 4. Fixing | 6' 30" |
| 5. Water-washing | 3' 15" |
| 6. Stabilization | 7' 30" |

Composition of color developer:
- 4-Amino-3-methyl-N-ethyl-N-(β-hydroxyethyl)-aniline sulfate: 4.8 g
- Anhydrous sodium sulfite: 0.14 g
- Hydroxyamine ½ sulfate: 1.98 g
- Sulfuric acid: 0.74 g
- Anhydrous potassium carbonate: 28.85 g
- Anhydrous potassium hydrogencarbonate: 3.46 g
- Anhydrous potassium sulfite: 5.10 g
- Potassium bromide: 1.16 g
- Sodium chloride: 0.14 g
- Nitrilotriacetic acid trisodium salt (monohydrate): 1.20 g
- Potassium hydroxide: 1.48 g
- Water to 1 liter.

Composition of bleaching solution:
- Iron ethylenediaminetetraacetic acid ammonium salt: 100.0 g
- Ethylenediaminetetraacetic acid diammonium salt: 10.0 g
- Ammonium bromide: 150.0 g
- Glacial acetic acid: 10.0 ml
- Water to 1 liter, adjusted to pH 6.0 with ammonia water.

Composition of fixing solution:
- Ammonium thiosulfate: 175.0 g
- Anhydrous sodium sulfite: 8.6 g
- Sodium metasulfite: 2.3 g
- Water to 1 liter, adjusted to pH 6.0 with acetic acid.

Composition of stabilizing solution:
- Formalin: 1.5 ml
- Konidax (produced by Konishiroku Photo Industry Co., Ltd.): 7.5 ml
- Water to 1 liter.

Subsequently, magenta color images formed on the samples and comparative samples respectively were measured in relative speed (assuming as 100 the speed at 20° C. and 60% RH of sample No. 1 in Table-3) and fog to obtain the results as shown in Table-3.

TABLE 3

| Sample | No. | Amount of compound added g/Ag mole | Exposed after storage for 3 days at 20° C. and 60% RH Speed | Fog | Exposed after storage for 3 days at 50° C. and 80% RH Speed | Fog | After exposure, stored for 3 days at 50° C. and 10% RH Speed |
|---|---|---|---|---|---|---|---|
| Comparative sample | 1 | Not added | 100 | 0.31 | 65 | 0.61 | 40 |
| | 2 | Comparative compound 2.0 | 80 | 70 | 0.35 | 40 | |
| | | | 0.25 | | | | |
| Sample | 3 | Exemplified compound (13) 2.0 | 100 | 0.24 | 90 | 0.30 | 60 |
| | 4 | Exemplified compound (22) 2.0 | 105 | 0.20 | 100 | 0.23 | 70 |
| | 5 | Exemplified compound (24) 2.0 | 100 | 0.22 | 100 | 0.26 | 65 |
| | 6 | Exemplified compound (34) 2.0 | 110 | 0.19 | 110 | 0.19 | 70 |
| | 7 | Exemplified compound (37) 2.0 | 100 | 0.19 | 100 | 0.21 | 70 |
| | 8 | Exemplified compound (42) 2.0 | 100 | 0.21 | 105 | 0.22 | 65 |
| | 9 | Exemplified compound (45) 2.0 | 100 | 0.23 | 95 | 0.28 | 70 |
| | 10 | Exemplified compound (51) 2.0 | 100 | 0.23 | 90 | 0.29 | 65 |
| | 11 | Exemplified compound (59) 1.0 | 100 | 0.29 | 70 | 0.58 | 45 |
| | 12 | Comparative compound 2.0 + Exemplified compound (59) 1.0 | 80 | 0.26 | 70 | 0.37 | 45 |
| | 13 | Exemplified compound (13) 2.0 + Exemplified compound (59) 1.0 | 100 | 0.23 | 100 | 0.30 | 100 |
| | 14 | Exemplified compound (60) 1.0 | 95 | 0.32 | 60 | 0.57 | 40 |

TABLE 3-continued

| Sample No. | Amount of compound added g/Ag mole | Exposed after storage for 3 days at 20° C. and 60% RH Speed | Fog | Exposed after storage for 3 days at 50° C. and 80% RH Speed | Fog | After exposure, stored for 3 days at 50° C. and 10% RH Speed |
|---|---|---|---|---|---|---|
| 15 | Exemplified compound (22) 2.0 + Exemplified compound (60) 1.0 | 105 | 0.21 | 100 | 0.24 | 95 |
| 16 | Exemplified compound (62) 1.0 | 100 | 0.28 | 70 | 0.59 | 40 |
| 17 | Exemplified compound (24) 2.0 + Exemplified compound (62) 1.0 | 110 | 0.22 | 105 | 0.25 | 100 |
| 18 | Exemplified compound (63) 1.0 | 100 | 0.30 | 65 | 0.60 | 45 |
| 19 | Exemplified compound (34) 2.0 + Exemplified compound (63) 1.0 | 105 | 0.18 | 100 | 0.21 | 100 |
| 20 | Exemplified compound (72) 1.0 | 100 | 0.29 | 70 | 0.58 | 45 |
| 21 | Exemplified compound (42) 2.0 + Exemplified compound (72) 1.0 | 105 | 0.20 | 100 | 0.21 | 90 |
| 22 | Exemplified compound (76) 1.0 | 100 | 0.31 | 70 | 0.59 | 45 |
| 23 | Exemplified compound (45) 2.0 + Exemplified compound (76) 1.0 | 100 | 0.24 | 100 | 0.27 | 85 |

As is clear from Table - 3, in the case of the comparative compound, a slight effect of inhibiting an increase in fog on storage at high temperature and humidity, but, on the other hand, desensitization is accompanied thereby. In contrast thereto, it is understood that the samples Nos. 3–10 containing the compounds of the present invention, in a similar manner as in Example 1, inhibit formation of fog without desensitization and demonstrate excellent photographic properties less in sensitivity decrease as well as in fog formation even when stored under the circumstances of high temperature and humidity.

Furthermore, it is understood that the latent image stabilization effect is markedly increased when the exemplified compounds (13), (22), (24), (34), (37), (42), (45) and (51) of the general formula [I] are used individually together with each of the exemplified compounds (59), (60), (62), (63), (72) and (76) of the general formulas [II] and [III] respectively, though the latent image inhibition effect is certainly observed when the exemplified compounds of the general formula [I] above are used singly. Of the compounds of the general formulas [II] and [III] respectively, moreover, the exemplified compounds (59), (60), (62) and (63) of the general formula [II], when individually used in combination with the compound of the general formula [I], demonstrate much increased latent image inhibition effect due to synergism.

In the light of the fact that no effect can be seen by the use of the compounds represented by the general formulas [II] and [III] respectively, either singly or in combination, it is readily understood that the effect realized by the combination of compounds according to the present invention is to make an epoch in the art concerned. Example 3

On a transparent cellulose triacetate film support were successively formed from the side of the support surface the following layers to obtain a multi-layered high speed negative color photosensitive materials (samples Nos. 1–5).

First layer: Antihalation layer

An aqueous gelatin solution containing black colloid silver and the under-mentioned dispersion A was coated on the support at 0.3 g of silver/m$^2$ and 0.32 g/m$^2$ of an oil drop component in the dispersion A. (Dry film thickness: 3.5$\mu$)

Dispersion A

Nine (9) g of a mixture of ultraviolet absorber compounds (A), (B), (C) and (D), which will be referred to later, the mixing ratio of (A):(B):(C):(D)=2:1:1:1, was dissolved by heating at 65° C. in a mixture of 15 g of dioctyl phthalate and 6 g of ethyl acetate. The solution was added to 100 cc of a 5% aqueous gelatin solution kept at 65° C. and containing 1 g of sodium triisopropylnaphthalenesulfonate and then dispersed with a colloid mill to prepare the title dispersion. [The compounds (A), (B), (C), and (D) are Tinuvin PS, Tinuvin-320, Tinuvin-326 and Tinuvin-327 respectively (trade names of products produced and sold by Ciba-Geigy Co.).]

Second layer: Intermediate layer

An aqueous gelatin solution was coated. (Dry film thickness: 1$\mu$)

Third Layer: Low speed red-sensitive silver halide emulsion layer

A mixture of 60 g per mole of silver halide of a cyan coupler, 1-hydroxy-N-[δ-(2,4-di-t-amylphenoxy)-butyl]-2-naphthamide, 4 g per mole of silver halide of a colored coupler, 1-hydroxy-4-[4-(1-hydroxy-δ-acetamido-3,6-disulfo-2-naphthylazo)phenoxy]-N-[δ-(2,4-di-t-amylphenoxy)butyl]-2-naphthamide disodium salt, 2.8 g per mole of silver halide of a DIR compound, 2-(1-phenyl-5-tetrazolylthio)-4-octadecylsuccinimido-1-indanone, and tricresyl phosphate as a high boiling solvent in an amount equal to the weight of couplers was charged with ethyl acetate, and the mixture was dispersed in the manner similar to Example 2 to prepare a dispersion. A silver iodobromide emulsion containing this dispersion was coated at 18 g of silver/m$^2$. (Dry film thickness: 4$\mu$)

This emulsion had been prepared by mixing a silver iodobromide emulsion having an average grain size of 0.6$\mu$ and containing 4 mol% of silver iodide with a silver iodobromide emulsion having an average grain size of 0.3$\mu$ and containing 4 mol% of silver iodide in the proportion of 2:1 and sensitized with dyes anhydro-5,5'-dichloro-9-ethyl-3,3'-di-(3-sulfopropyl)thiacarbocyanine hydroxide and anhydro-9-ethyl-3,3'-di-(3-sulfopropyl)-4,5,4',5'-dibenzothiacarbocyanine hydroxide.

Fourth layer: High speed red-sensitive silver halide emulsion layer

A mixture of 15 g per mole of silver halide of a cyan coupler, 1-hydroxy-4-(isopropylcarbamoyl)methoxy-N-dodecyl-2-naphthamide, 1.5 g per mole of silver halide of a colored coupler, 1-hydroxy-4-[4-(1-hydroxy-δ-acetamido-3,6-disulfo-2-naphthylazo)phenoxy]-N-[δ-(2,4-di-t-amylphehoxy)-butyl]-2-naphthamide disodium salt, 2.1 g per mole of silver halide of a DIR compound, 2-(1-phenyl-5-tetrazolylthio)-4-octadecylsuccinimido-1-indanone, and tricresyl phosphate as a high boiling solvent in an amount equal to the weight of the couplers, was dissolved in ethyl acetate and then dispersed in the manner similar to Example 2 to prepare a dispersion. A silver iodobromide emulsion containing this dispersion was coated at 10 g of silver/m$^2$. (Dry film thickness: 2$\mu$)

This emulsion was a silver iodobromide emulsion having an average grain size of 1.2$\mu$ and containing 7 mol% of silver iodide and sensitized with the same dyes as in the third layer.

Fifth layer: Intermediate layer

This layer was the same as in the second layer.

Sixth layer: Low speed green-sensitive silver halide emulsion layer

A mixture of 48 g per mole of silver halide of a magenta coupler, 1-(2,4,6-trichlorophenyl)-3-[3-(2,4-di-t-amylphenoxyacetamido)benzamido]-5-pyrazolone, 12 g per mole of silver halide of a colored coupler, 1-(2,4,6-trichlorophenyl)-3-(2-chloro-5-octadecenylsuccinimidoanilino)-4-(4-hydroxyphenylazo)-5-pyrazolone, 1.8 g per mole of silver halide of a DIR compound, 2-(1-phenyl-5-tetrazolylthio)-4-octadecylsuccinimido-1-indanone, and tricresyl phosphate as a high boiling solvent in an amount equal to the weight of the couplers, was dissolved in ethyl acetate and the solution was then dispersed in the manner similar to Example 2 to prepare a dispersion. A silver iodobromide emulsion containing this dispersion was coated at 14 g of silver/m$^2$. (Dry film thickness: 4$\mu$) This emulsion had been prepared by mixing a silver iodobromide emulsion having an average grain size of 0.6$\mu$ and containing 4 mol% of silver iodide with a silver iodobromide emulsion having an average grain size of 0.3$\mu$ and containing 7 mol% of silver iodide in the proportion of 2:1, and sensitized with dyes, anhydro-5,5'-dichloro-9-ethyl-3,3'-di-(3-sulfopropyl)oxacarbocyanine hydroxide, anhydro-5,5'-diphenyl-9-ethyl-3,3'-di-(3-sulfopropyl)oxacarbocyanine hydroxide and anhydro-9-ethyl-3,3'-di-(3-sulfopropyl)-5,6,5',6'-benzoxacarbocyanine hydroxide.

Seventh layer: High speed green-sensitive silver halide emulsion layer

A mixture of 2.1 g per mole of silver halide of a magenta coupler, 1-(2,4,6-trichlorophenyl)-3-[3-(2,4-di-t-aminophenoxyacetamido)benzamido]-5-pyrazolone, 3 g per mole of silver halide of a colored coupler, 1-(2,4,6-trichlorophenyl)-3-(2-chloro-5-octadecenylsuccinimidoanilino)-4-(4-hydroxyphenylazo)-5-pyrazolone, 1 g per mole of silver halide of a DIR compound, 2-(1-phenyl-5-tetrazolylthio)-4-octadecylsuccinimido-1-indanone, and tricresyl phosphate as a high boiling solvent in an amount equal to the weight of the couplers, was dissolved in ethyl acetate, and the solution was dispersed in the manner similar to Example 2 to prepare a dispersion.

A silver iodobromide emulsion containing this dispersion was coated at 12 g of silver/m$^2$. (Dry film thickness: 1.8$\mu$) This emulsion was a silver iodobromide emulsion having an average grain size of 1.2$\mu$ and containing 7 mol% of silver iodide and sensitized with the same dyes as in the sixth layer.

Eighth layer: Intermediate layer

The same as the second layer.

Ninth layer: Yellow filter layer

An aqueous gelatin solution containing yellow colloid silver and 2,5-di-t-octylhydroquinone was coated at 0.1 g of silver/m$^2$.

Tenth layer: Low speed blue-sensitive silver halide emulsion layer

A mixture of 200 g per mole of silver halide of a yellow coupler, $\alpha$-[(1-benzyl-2-phenyl-3,5-dioxo-1,2,4-triazolidinyl)]-$\alpha$-pivaryl-2-chloro-5-($\delta$-(2,4-di-t-amylphenoxy)butylamido acetanilide, and dibutyl phthalate as a high boiling solvent in an amount equal to the weight of the couplers was dissolved in ethyl acetate, and the solution was dispersed in the manner similar to Example 2 to prepare a dispersion. A silver iodobromide emulsion containing this dispersion was coated at 5 g of silver/m$^2$ (Dry film thickness: 4$\mu$). This emulsion was a silver iodobromide emulsion having an average grain size of 0.6$\mu$ and containing 8 mol% silver iodide and sensitized with a dye, anhydro-3,3'-(3-sulfopropyl)selenacyanine hydroxide.

Eleventh layer: High speed green-sensitive silver halide emulsion

A silver iodobromide emulsion containing 130 g per mol of silver of the same yellow coupler as in the tenth layer was coated at 7 g of silver/m$^2$ (Dry film thickness: 3$\mu$).

This emulsion was a silver iodobromide emulsion having an average grain size of 1.2$\mu$ and containing 7 mol% of silver iodide, and sensitized with the same dye as in the tenth layer.

Twelfth layer: Intermediate layer

An aqueous gelatin solution containing the same dispersion A as in the first layer was coated at 0.32 g/m$^2$ of an oil drop component in the dispersion A. (Dry film thickness: 1.2$\mu$)

Thirteenth layer: Protective layer

An aqueous gelatin solution containing silica of an average grain size of 5$\mu$ as a matting agent, a slipping agent(1) and an organofluoro compound(2) was coated at 0.02 g of silica/m$^2$, 0.04 g of the slipping agent/m$^2$ and 5 mg of the fluoroorgano compound/m$^2$. (Dry film thickness: 0.5$\mu$)

Slipping Agent(1)

$$\begin{array}{l} CH_2-OOC-nC_{11}H_{23} \\ | \\ CH-OOC-nC_{11}H_{23} \\ | \\ CH_2-OOC-nC_{11}H_{23} \end{array}$$

Organofluoro compound(2)

$$\begin{array}{l} \quad\quad CH_2-COOCH_2-(CF_2)_6-H \\ \quad\quad\quad | \\ NaO_3S-CH-COOCH_2-(CF_2)_6-H \end{array}$$

The multi-layered high speed color negative photosensitive material thus prepared was taken as a comparative sample (sample No. 1).

Subsequently, samples were prepared in the manner similar to the comparative sample, except that ethyl gallate as a comparative compound and the compounds of the present invention were individually added to the samples in the manner as indicated in Table 4 after completion of the second ripening of each of silver iodobromide emulsions used in the third, fourth, sixth, seventh, tenth and eleventh layers respectively.

The comparative samples and the samples thus prepared were subjected to forced deterioration test and color development similar to Example 1. The cyan image, magenta image and yellow image formed on each sample thus processed were measured in speed and fog (wavelength at which the measurement was made:

434 nm, 547 nm, and 651 nm, respectively) to obtain the results as shown in Table - 4.

The speed in the table was represented by a relative value measured by assuming at 100 the speed of the red-sensitive layer of the sample No. 1 at 20° C. and 60% RH. Furthermore, the latent image stability was represented by a value fluctuated in each color density of each sample stored, after exposure, at 50° C. and 10% RH on the basis of each color density in the exposured area where a density of the magenta image of each sample became 1.5 at 20° C. and 60% RH.

TABLE 5

| | Amount repleshed 0.1 $m^2$ sample | Tank capacity of Hanger type automatic developing machine |
|---|---|---|
| Color developer | 140 ml. | 80 l. |
| Bleaching solution | 179 ml. | 160 l. |
| Fixing solution | 111 ml. | 160 l. |
| Stabilizing solution | 111 ml. | 80 l. |

TABLE 4

| Sample No. | | Compound added g/Ag mole each layer | Exposed after storage for 3 days at 20° C. and 60% RH | | | | | | Exposed after storage for 3 days at 50° C. and 80% RH | | | | | | Stored, after exposure, for 3 days at 50° C. and 10% RH | | |
|---|---|---|---|---|---|---|---|---|---|---|---|---|---|---|---|---|---|
| | | | Speed | | | Fog | | | Speed | | | Fog | | | Value fluctuated in density | | |
| | | | R | G | B | R | G | B | R | G | B | R | G | B | R | G | B |
| Comparative sample | 1 | Not added (Comparative) | 100 | 180 | 270 | 0.21 | 0.58 | 0.82 | 75 | 95 | 230 | 0.31 | 1.00 | 0.95 | +0.43 | +0.54 | −0.42 |
| | 2 | Comparative compound 2.0 | 80 | 155 | 210 | 0.18 | 0.55 | 0.76 | 60 | 135 | 180 | 0.26 | 0.85 | 0.90 | +0.38 | +0.37 | −0.33 |
| Sample | 3 | Exemplified compound (3) 2.0 | 100 | 175 | 280 | 0.14 | 0.42 | 0.62 | 95 | 170 | 275 | 0.16 | 0.45 | 0.64 | +0.21 | +0.24 | −0.27 |
| | 4 | Exemplified compound (9) 2.0 | 105 | 180 | 275 | 0.16 | 0.46 | 0.60 | 100 | 185 | 270 | 0.18 | 0.51 | 0.65 | +0.16 | +0.21 | −0.19 |
| | 5 | Exemplified compound (34) 2.0 + Exemplified compound (63) 1.0 | 100 | 185 | 290 | 0.14 | 0.40 | 0.63 | 100 | 180 | 285 | 0.16 | 0.43 | 0.67 | +0.02 | −0.04 | ±0 |
| | 6 | Exemplified compound (19) 2.0 + Exemplified compound (75) 1.0 | 100 | 180 | 275 | 0.15 | 0.48 | 0.65 | 95 | 175 | 260 | 0.19 | 0.53 | 0.70 | +0.08 | +0.09 | −0.05 |

As is clear from Table - 4, it is understood that by virtue of the application of the compounds of the present invention to silver halide emulsion layers of the multi-layered color negative photosensitive material, the samples 3 and 8, as compared with the comparative samples 1 and 2, have been provided with excellent stability in photographic performance under severe circumstances of high temperature and humidity.

Furthermore, it is clearly understood that by virtue of the use in combination of the present compounds, as can be seen from the results obtained in the samples 5 and 6, each emulsion layer is markedly reduced in latent image fluctuation, and the samples have prominent characteristics with good color balance. Example 4

The samples obtained in Example 3 were subjected to running process using a continuous developing apparatus, i.e. a hanger type automatic developing machine (TYPE KII—1307 manufactured and sold by Noritsu Koki K.K.) to investigate developability of said samples, which developability might be adversely affected by the compounds eluted from silver halide emulsion layers and accumulated in the developing bath during continuous development.

In the running process carried out under the conditions using the processing solutions as indicated in Example 2, 100 square meters of each sample was processed while supplementing the replenisher solutions in the manner as shown in Table - 5 at the end of each processing of 0.1 square meter of each sample.

Composition of replenisher solution

Composition of color developing replenisher solution:
- 4-Amino-3-methyl-N-ethyl-N-(β-hydroxyethyl)-aniline sulfate: 5.25 g
- Anhydrous sodium sulfite: 4.5 g
- Sulfuric acid hydroxylamine: 2.8 g
- Anhydrous potassium carbonate: 37.5 g
- Anhydrous sodium sulfite: 4.5 g
- Sodium bromide: 0.9 g
- Nitrilotriacetic acid trisodium: 2.5 g
- 45% potassium hydroxide solution: 1.7 ml
- Water to 1 liter.

Composition of bleaching replenisher solution:
- Iron ethylenediaminetetraacetic acid ammonium salt: 126 g
- Ammonium bromide: 172 g
- Glacial acetic acid: 16.8 ml
- Sodium nitrate: 40.2 g
- Water to 1 liter.

Composition of fixing replenisher solution:
- Ammonium thiosulfate: 94.5 g
- Anhydrous sodium bisulfite: 15.0 g
- Iron ethylenediaminetetraacetic acid disodium salt: 1.5 g
- Sodium hydroxide: 2.75 g
- Water to 1 liter.

Composition of stabilizing replenisher solution:
- Formalin: 2.6 ml
- Konidax (produced and sold by Konishiroku Photo Industry Co., Ltd.): 11.3 ml
- Water to 1 liter.

Using the processing solutions at the start of the running process as well as the fatigued solutions after completion of the running process, the sample 4 was processed and then subjected to sensitometry to measure speed, gamma (represented by tan $\theta$ of characteristic curve) and maximum density. The results obtained were as shown in Table—6.

In the table, the speed was represented by a relative value measured by assuming as 100 the speed of the red-sensitive layer at the start of the running process.

TABLE 6

| Running sample | At the start of the running process | | | | | | | | | At the completion of the running | | | | | | | | |
|---|---|---|---|---|---|---|---|---|---|---|---|---|---|---|---|---|---|---|
| | Speed | | | Gamma | | | Maximum density | | | Speed | | | Gamma | | | Maximum density | | |
| | R | G | B | R | G | B | R | G | B | R | G | B | R | G | B | R | G | B |
| Sample 2 | 100 | 185 | 290 | 0.53 | 0.62 | 0.74 | 1.90 | 2.47 | 3.12 | 70 | 105 | 145 | 0.50 | 0.57 | 0.60 | 1.80 | 2.18 | 2.35 |
| Sample 4 | " | " | " | " | " | " | " | " | " | 95 | 185 | 285 | 0.53 | 0.63 | 0.74 | 1.92 | 2.45 | 3.11 |
| Sample 6 | " | " | " | " | " | " | " | " | " | 100 | 185 | 295 | 0.53 | 0.64 | 0.73 | 1.90 | 2.46 | 3.10 |

As is clear from the results indicated in Table—6, it is clearly understood that the running bath, with which the sample 2 has been processed and might contain ethyl gallate, strongly shows suppression of the photographic properties, whereas the running bath, with which the samples 4 and 6 have been processed and might contain the compounds of the present invention, favorably maintains said properties as observed at the start of the running process and thus no adverse effect is seen at all even when the present compounds elute into the developing bath and accumulate therein.

EXAMPLE 5

On a transparent polyethylene terephthalate film support were successively coated from a side of the support surface the following individual layers to prepare a multilayered color reversal photosensitive material (samples Nos. 1–5).

First layer: Antihalation layer

An aqueous gelatin solution containing black colloid silver was coated on the support at 0.3 g of silver/m$^2$ so as to form a layer of a dry film thickness of 3$\mu$.

Second layer: Intermediate layer

An aqueous gelatin solution was coated so as to form a layer of a dry film thickness of 1$\mu$.

Third layer: Low speed red-sensitive silver halide emulsion layer

A silver iodobromide emulsion containing 25 g per mole of silver halide of a cyan coupler, 1-hydroxy-N-[$\delta$(2,4-di-t-amylphenoxy)butyl]-2-naphthamide was coated at 18 g of silver/m$^2$ (Dry film thickness: 4$\mu$).

This emulsion was a silver iodobromide emulsion containing 6 mol% of silver iodide and sensitized with dyes, anhydro-5,5'-dichloro-9-ethyl-3,3'-di-(3-sulfopropyl)-thiacarbocyanine hydroxide and anhydro-9-ethyl-3,3'-di-(3-sulfopropyl)-4,4,4',5'-dibenzothiacarbocyanine hydroxide.

Fourth layer: High speed red-sensitive silver halide emulsion layer

A silver iodobromide emulsion containing 25 g per mole of silver halide of a cyan coupler, 1-hydroxy-N-[$\delta$-(2,4-di-t-amylphenoxy)butyl]-2-naphthamido was coated at 10 g of silver/m$^2$ (Dry film thickness: 2$\mu$).

This emulsion was a silver iodobromide emulsion containing 6 mol% of silver iodide and sensitized with the same dyes as in the third layer.

Fifth layer: Intermediate layer

The same as the second layer.

Sixth layer: Low speed green-sensitive silver halide emulsion layer

A silver iodobromide emulsion containing 30 g per mole of silver halide of a magenta coupler, 1-(2,4,6-trichlorophenyl)-3-[3-(2,4-di-t-amylphenoxyacetamido)benzamido]-5-pyrazolone was coated at 14 g of silver/m$^2$ (Dry film thickness: 4$\mu$).

This emulsion was a silver iodobromide emulsion containing 6 mol% of silver iodide and sensitized with dyes, anhydro-5,5'-diphenyl-9-ethyl-3,3'-di-(3-sulfopropyl)oxacarbocyanine hydroxide and anhydro-5,5',6,6'-tetra-chloro-1,1'-di-ethyl-3,3'-di-(3-sulfopropyl)imidacarbocyanine hydroxide.

Seventh layer: High speed green-sensitive silver halide emulsion layer

A silver iodobromide emulsion containing 30 g per mole of silver halide of a magenta coupler, 1-(2,4,6-trichlorophenyl)-3-[3-(2,4-di-t-amylphenoxyacetamido)benzamido]-5-pyrazolone was coated at 12 mg of silver/m$^2$ (Dry film thickness: 1.8$\mu$).

This emulsion was a silver iodobromide emulsion containing 6 mol% of silver iodide and sensitized with the same dyes as in the sixth layer.

Eighth layer: Intermediate layer

The same as the second layer.

Ninth layer: Yellow filter layer

An aqueous gelatin solution containing yellow colloid silver was coated at 0.1 g of silver/m$^2$ so as to form a layer of a dry film thickness of 1.3$\mu$.

Tenth layer: Low speed blue-sensitive silver halide emulsion layer

A silver iodobromide emulsion containing 90 g per mole of silver halide of a yellow coupler, $\alpha$-[4-(1-benzyl-2-phenyl-3,5-dioxo-1,2,4-triazolidinyl)]-$\alpha$-pivaryl-2-chloro-5-[$\gamma$-(2,4-di-t-amylphenoxy)-butylamido]acetanilide was coated at 5 g of silver/m$^2$ (Dry film thickness: 4.0$\mu$).

This emulsion was a silver iodobromide emulsion containing 6 mol% of silver iodide and sensitized with a dye, anhydro-3,3'-(3-sulfopropyl)-selenacyanine hydroxide.

Eleventh layer: High speed blue-sensitive silver halide emulsion layer

A silver iodobromide emulsion containing 90 g per mole of silver halide of a yellow coupler, $\alpha$-[4-(1-benzyl-2-phenyl-3,5-dioxo-1,2,4-triazolidinyl]-$\alpha$-pivaryl-2-chloro-5-[$\gamma$-(2,4-di-t-amylphenoxy)-butylamido]acetanilide was coated at 7 g of silver/m$^2$ (Dry film thickness: 3$\mu$).

This emulsion was a silver iodobromide emulsion containing 6 mol% of silver iodide and sensitized with the same dyes as in the ninth layer.

Twelfth layer: Protective layer

An aqueous gelatin solution was coated at 1.3 g of gelatin/$m^2$ (Dry film thickness: 1.2$\mu$).

The multi-layered color reversal photosensitive material thus prepared was taken as a comparative sample (sample No. 1).

Subsequently, samples were prepared in the manner similar to the comparative sample, except that after completion of the second ripening, each of the third, fourth, sixth, seventh, tenth and eleventh layers was incorporated with the compounds of the present invention in the manner as indicated in Table—7.

The comparative sample and samples thus prepared were subjected to forced deterioration test similar to Example 1 and then subjected to color development step mentioned below.

| (Processing step) | (Temperature) | (Processing time) |
|---|---|---|
| First development | 38° C. | 6' |
| First water-washing | 38° C. | 2' |
| Reversal | 38° C. | 2' |
| Color development | 38° C. | 6' |
| Adjustment | 38° C. | 2' |
| Bleaching | 38° C. | 6' |
| Fixing | 38° | |
| Stabilizing | 4' | |
| Final water-washing | 38° C. | 4' |
| Stabilizing 38° C. | 30" | |
| Drying | 50° C. | |

The composition of processing solution used in each processing step was as follows:

First developer:

Nitrilo-N,N,N-trimethylenesulfonic acid pentasodium aqueous solution (45%): 1.0 ml
Potassium sulfite dihydrate: 35.0 g
Sodium bromide: 2.2 g
Sodium thiocyanate: 1.0 g
Potassium iodide: 4.5 mg
Potassium hydroxide: 4.5 g
Diethylene glycol: 12.0 ml
1-Phenyl-4-hydroxymethyl-3-pyrazolidone: 1.5 g
Anhydrous potassium carbonate: 14.0 g
Sodium bicarbonate: 12.0 g
Potassium hydroquinonesulfonate: 22.0 g
Water to 1 liter and adjusted to pH 9.6.

Reversal solution:

Anhydrous sodium acetate: 10.0 g
Anhydrous stannous chloride: 1.5 g
Hydroxylamine sulfate: 0.1 g
Sodium hydroxide: 10.0 g
Citric acid monohydrate: 20.0 g
Water to 1 liter and adjusted to pH 5.8.

Color developer:

Pentasodium nitrilo-N,N,N-trimethylenesulfonate (45% aq. soln.): 5.0 ml
Phosphoric acid (85%): 7.0 ml
Sodium bromide: 0.7 g
Potassium iodide: 30.0 mg
Potassium hydroxide: 20.0 g
Anhydrous sodium sulfite: 4.5 g
Citrazinic acid: 1.3 g
4-Amino-N-ethyl-N-($\beta$-methansulfoneamidoethyl)-m-toluidinesesquisulfate monohydrate: 11.0 g
1,8-Hydroxy-3,6-dithiaoctane: 1.0 g
Water to 1 liter and adjusted to pH 11.7.

Adjusting solution:

Potassium sulfite: 15.0 g
Ethylenediaminetetraacetic acid: 8.0 g
$\alpha$-Monothioglycerol: 0.5 ml
Water to 1 liter and adjusted to pH 6.2.

Bleaching solution:

Potassium nitrate: 25.0 g
Potassium bromide: 80.0 g
Iron (III) ammonium ethylenediaminetetraacetate: 110.0 g
Hydrobromic acid (48%): 30.0 ml
Ethylenediaminetetraacetic acid: 4.0 g
Water to 1 liter and adjusted to pH 5.7.

Fixing solution:

Ammonium thiosulfate: 55.0 g
Disodium ethylenediaminetetraacetate: 0.8 g
Sodium metabisulfite: 7.5 g
Sodium hydroxide: 1.5 g
Water to 1 liter and adjusted to pH 6.6.

Stabilizing solution:

Formalin (35%): 6.0 ml
Konidax (produced and sold by Konishiroku Photo Industry Co., Ltd.): 7.5 ml
Water to 1 liter.

The cyan image, magenta image and yellow image formed on each sample thus processed were individually measured in speed and maximum density to obtain the results as shown in Table—7.

In the table, the speed was represented by a relative value measured by assuming as 100 the speed of the red-sensitive layer of the sample No. 1 at 20° C. and 60% RH.

Furthermore, the latent image stability was represented by a value fluctuated in each density of each sample stored, after exposure, at 50° C. and 10% RH on the basis of each color density in the exposed area where a density of the magenta image of each sample became 1.5 at 20° C. and 60% RH.

TABLE 7

| Sample No. | | Compound added mg/Ag mole each layer | Exposed after storage for 3 days at 20° C. and 60% RH: Speed R | G | B | Maximum density R | G | B | Exposed after storage for 3 days at 50° C. and 80% RH: Speed R | G | B | Maximum density R | G | B | Stored, after exposure, for 3 days at 50° C. and 10% RH: Value fluctuated in density R | G | B |
|---|---|---|---|---|---|---|---|---|---|---|---|---|---|---|---|---|---|
| Comparative sample | 1 | Not added (Comparative) | 100 | 125 | 130 | 3.20 | 3.31 | 3.44 | 85 | 105 | 110 | 3.05 | 3.17 | 3.24 | −0.18 | −0.09 | +0.07 |
| Sample | 2 | Exemplified compound (6) 2.0 | 100 | 126 | 130 | 3.33 | 3.42 | 3.60 | 95 | 125 | 130 | 3.29 | 3.38 | 3.59 | −0.12 | −0.03 | +0.04 |
| | 3 | Exemplified | | | | | | | | | | | | | | | |

TABLE 7-continued

| Sample No. | Compound added mg/Ag mole each layer | Exposed after storage for 3 days at 20° C. and 60% RH: Speed R | G | B | Maximum density R | G | B | Exposed after storage for 3 days at 50° C. and 80% RH: Speed R | G | B | Maximum density R | G | B | Stored, after exposure, for 3 days at 50° C. and 10% RH: Value fluctuated in density R | G | B |
|---|---|---|---|---|---|---|---|---|---|---|---|---|---|---|---|---|
| | compound (25) 2.0 | 105 | 130 | 135 | 3.35 | 3.47 | 3.61 | 100 | 125 | 135 | 3.30 | 3.47 | 3.60 | −0.11 | −0.04 | −0.02 |
| 4 | Exemplified compound (42) 2.0 + Exemplified compound (59) 1.0 | 100 | 125 | 130 | 3.30 | 3.44 | 3.58 | 95 | 125 | 125 | 3.28 | 3.40 | 3.57 | +0.02 | ±0 | −0.01 |
| 5 | Exemplified compound (47) 2.0 + Exemplified compound (64) 1.0 | 100 | 120 | 135 | 3.34 | 3.46 | 3.60 | 100 | 115 | 135 | 3.35 | 3.45 | 3.62 | +0.04 | −0.01 | ±0 |

What we claim is:

1. A photographic material having a light-sensitive silver halide emulsion layer coated on a support which material contains a compound represented by the following general formula [Ia] or [Ib]

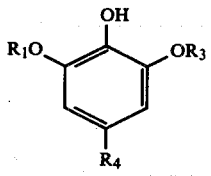

[Ia],

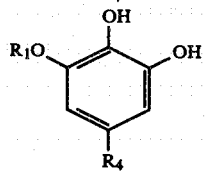

[Ib]

wherein $R_1$ and $R_3$ individually represent an alkyl, alkenyl or acyl group; $R_4$ represents a halogen atom, an alkyl, alkenyl, cycloalkyl or cyano group, or $—SO_2R_5$ or $—COR_5$ group; and $R_5$ represents a hydrogen atom, a hydroxy, alkyl, alkoxy, cycloalkoxy, aryloxy or amino group.

2. A photographic material according to claim 1 wherein $R_1$ and $R_3$ in the general formula [Ia] and $R_1$ in the general formula [Ib] are individually an alkyl or acyl group.

3. A photographic material according to claim 1 wherein the material further comprises a compound of the general formula [II] or [III].

General formula (II)

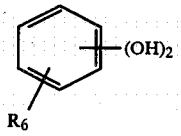

General formula (III)

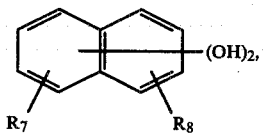

in which $R_6$ represents an alkyl group, $R_7$ and $R_8$ represent individually a hydrogen atom or an alkyl group, provided that $R_7$ and $R_8$ are not simultaneously hydrogen atoms.

4. A photographic material according to claim 3 wherein the compound is one represented by the general formula [II].

5. A photographic material according to claim 4 wherein the two hydroxy groups are in ortho-position.

6. A photographic material according to claim 1 which is used for color photographic material.

7. A photographic material according to claim 1 which comprises a coupler.

8. A photographic material according to claim 7 which comprises a blue-sensitive silver halide emulsion layer containing a yellow dye image forming coupler, a green-sensitive silver halide emulsion layer containing a magenta dye image forming coupler, and a red-sensitive silver halide emulsion layer containing a cyan dye image forming coupler.

* * * * *

UNITED STATES PATENT AND TRADEMARK OFFICE

CERTIFICATE OF CORRECTION

PATENT NO. : 4,252,893

DATED : February 24, 1981

INVENTOR(S) : Masao Iwamuro et al.

It is certified that error appears in the above—identified patent and that said Letters Patent is hereby corrected as shown below:

First page, under "Foreign Application Priority Data"

change "Apr. 11, 1979 [JP] Japan ... 54-42380" to

--Apr. 11, 1978 [JP] Japan ... 53-42380--

Signed and Sealed this

*Nineteenth* Day of *May 1981*

[SEAL]

*Attest:*

RENE D. TEGTMEYER

*Attesting Officer*

*Acting Commissioner of Patents and Trademarks*